US009982378B2

(12) United States Patent
Schmitz

(10) Patent No.: US 9,982,378 B2
(45) Date of Patent: May 29, 2018

(54) DEVICE FOR TREATING STRAND-SHAPED TEXTILE FABRIC IN THE FORM OF AN ENDLESS FABRIC STRAND

(71) Applicant: FONG'S EUROPE GMBH, Schwäbisch Hall (DE)

(72) Inventor: Johannes Schmitz, Coesfeld (DE)

(73) Assignee: FONG'S EUROPE GMBH, Schwäbisch Hall (DE)

( * ) Notice: Subject to any disclaimer, the term of this patent is extended or adjusted under 35 U.S.C. 154(b) by 0 days. days.

(21) Appl. No.: 15/024,350

(22) PCT Filed: Sep. 20, 2014

(86) PCT No.: PCT/EP2014/070064
§ 371 (c)(1),
(2) Date: Mar. 23, 2016

(87) PCT Pub. No.: WO2015/040199
PCT Pub. Date: Mar. 26, 2015

(65) Prior Publication Data

US 2016/0244901 A1 Aug. 25, 2016

(30) Foreign Application Priority Data

Sep. 23, 2013 (DE) ..... 10 2013 110 492

(51) Int. Cl.
*D06B 3/24* (2006.01)
*D06B 3/28* (2006.01)
*B65H 20/14* (2006.01)

(52) U.S. Cl.
CPC ..... *D06B 3/24* (2013.01); *B65H 20/14* (2013.01); *D06B 3/28* (2013.01); *D06B 2700/10* (2013.01)

(58) Field of Classification Search
CPC ..... D06B 3/24; D06B 3/28; B65H 20/14
(Continued)

(56) References Cited

U.S. PATENT DOCUMENTS 3,924,424 A 12/1975 Watanabe et al.
4,019,351 A 4/1977 Mizutani et al.
(Continued)

FOREIGN PATENT DOCUMENTS

CN 102359004 A 2/2012
DE 2207679 A1 8/1973
(Continued)

OTHER PUBLICATIONS

Taiwanese Office Action (and English translation thereof) dated Feb. 17, 2017, issued in counterpart Taiwanese Application No. 1021414687.
(Continued)

*Primary Examiner* — Joseph L. Perrin
(74) *Attorney, Agent, or Firm* — Holtz, Holtz & Volek PC

(57) ABSTRACT

A device for treatment of a strand-like textile fabric in the form of an endless fabric strand, includes: a lockable treatment container; a transport nozzle arrangement which can be subjected to a first transport medium flow; and a transport section adjoining the transport nozzle arrangement. The transport section terminates on a fabric strand inlet side in a storage section of the lockable treatment container, and the storage section accommodates a folded fabric strand pile. The transport nozzle arrangement includes a transport nozzle with a polygonal nozzle inlet opening and an outlet part having a polygonal cross-section, for the fabric strand. The outlet part is appropriately adapted in view of its dimensions. The nozzle gap is adjustable and is delimited all the way around on at least one side by a plurality of straight nozzle elements that each have a cross-sectional shape that is essentially part-cylindrical.

14 Claims, 12 Drawing Sheets

Figure 1:
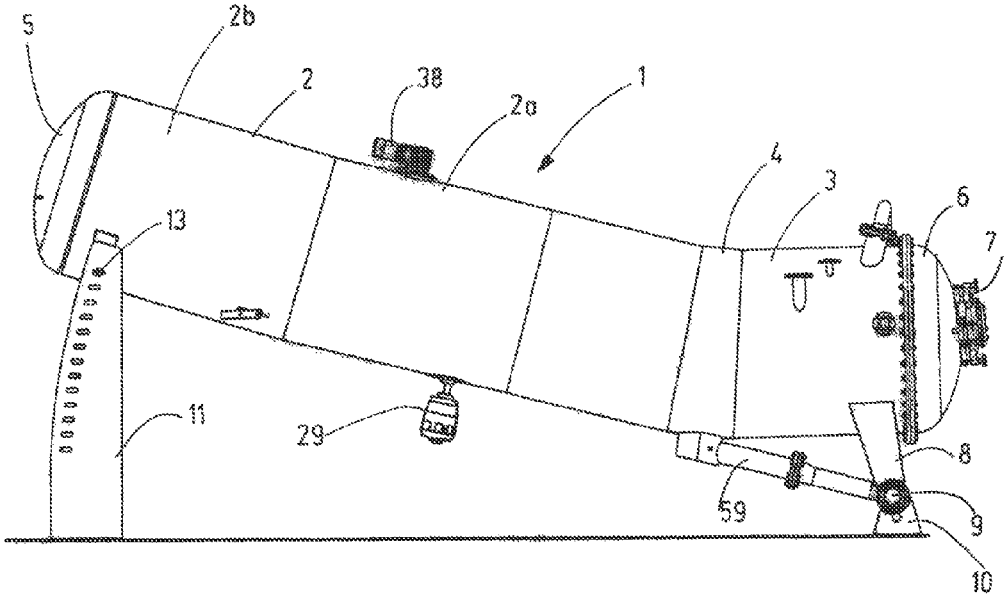

(58) Field of Classification Search
USPC ..... 68/177, 178, 179; 8/151, 151.2, 152; 226/97.4
See application file for complete search history.

(56) References Cited

U.S. PATENT DOCUMENTS

| | | | | | |
|---|---|---|---|---|---|
| 4,570,464 | A * | 2/1986 | Thompson | D06B 3/28 | 68/178 |
| 4,977,761 | A * | 12/1990 | Hacker | D06B 3/28 | 68/177 |
| 5,014,525 | A | 5/1991 | Bene | | |
| 5,235,828 | A | 8/1993 | Aurich et al. | | |
| 5,520,027 | A * | 5/1996 | McCartney | D06B 3/28 | 68/13 R |
| 5,746,072 | A * | 5/1998 | Bohnke | D06B 3/28 | 226/97.4 |
| 5,850,651 | A | 12/1998 | Ishimaru et al. | | |
| 7,886,390 | B2 | 2/2011 | Christ et al. | | |
| 8,746,018 | B2 | 6/2014 | Christ | | |
| 2005/0066694 | A1* | 3/2005 | Marcora | D06B 3/28 | 68/12.14 |
| 2006/0253999 | A1 | 11/2006 | Christ et al. | | |
| 2007/0137562 | A1* | 6/2007 | Cordes | D06B 3/28 | 118/325 |
| 2007/0283725 | A1* | 12/2007 | Cordes | D06B 3/28 | 68/5 C |
| 2008/0263782 | A1* | 10/2008 | Christ | D06B 3/28 | 8/149.1 |
| 2010/0175200 | A1* | 7/2010 | Christ | D06B 3/28 | 8/152 |

FOREIGN PATENT DOCUMENTS

| | | | | |
|---|---|---|---|---|
| DE | 3613364 | A1 | 2/1987 | |
| DE | 3734260 | C1 | 2/1989 | |
| DE | 202004003500 | U1 | 9/2004 | |
| DE | 102007036408 | B3 | 12/2008 | |
| EP | 0531868 | A1 | 3/1993 | |
| EP | 1722023 | A2 | 11/2006 | |
| EP | 1985738 | A1 | 10/2008 | |
| FR | 2681364 | A1 | 3/1993 | |
| GB | 2246372 | A * | 1/1992 | D06B 3/28 |
| JP | 07305261 | A | 11/1995 | |
| TW | 200934910 | A | 8/2009 | |

OTHER PUBLICATIONS

International Search Report (ISR) and Written Opinion (WO) dated Dec. 18, 2014 issued in International Application No. PCT/EP2014/070064.

* cited by examiner

DEVICE FOR TREATING STRAND-SHAPED TEXTILE FABRIC IN THE FORM OF AN ENDLESS FABRIC STRAND

The invention relates to a device for treating strand-shaped textile fabric in the form of an endless fabric strand, which is set in circulation at least during part of its treatment.

For finishing and the treatment in general of synthetic strand-shaped textile fabric, in particular, so-called long storage machines are widely used in the discontinuous piece by piece finishing. These long storage machines comprise an elongated, essentially tubular, treatment container and, arranged therein, a transport nozzle arrangement that can be subjected to a liquid and/or gaseous transport medium flow. Adjoining the transport nozzle arrangement, there is a transport section that terminates on a fabric strand inlet side in a storage section of the treatment container accommodating a plaited fabric strand. As a rule, the storage section contains a gliding bottom at a distance above the container wall below, said gliding bottom extending from the fabric strand inlet side of the storage section to a fabric outlet side in the vicinity of the transport nozzle arrangement.

Examples of such long storage machines are described in publications DE 2 207 679 A, DE 36 13 364 C2, DE 10 2007 036 408 B3 and FR 2 681 364, to mention only a few examples. As a rule, these machines are processed in a floating manner at a relatively high bath ratio (1:8 to 1:2) in the treatment bath. The fabric strand drive comprises a reel and a transport nozzle. In many cases the reel is a source of material damage resulting in dragging points or fabric displacement. This is due to low contact forces between the fabric strand and the reel as well as due to smooth reel surfaces; and, due to a fluid film between the fabric strand and the reel, the pulling action of the reel is frequently more likely rather minimal. Furthermore, the coordination of the fabric strand velocity generated by the transport nozzle and the reel circumferential speed is a problem in many cases. With the use of reels that are freely moving in fabric strand transport direction, it is attempted to reduce surface damage to the treated textile fabric caused by the decelerating effect of the reel.

A long storage machine is also known from publication U.S. Pat. No. 5,850,651, wherein a reel is omitted in one embodiment and the drive of the circulating fabric strand is achieved by air or an air/fluid mixture as the transport medium with which a transport nozzle can be loaded. A design of a long storage machine that, in principle, is similar is known from publication JP 07 305261 A. This machine also operates without a reel. The material transport is accomplished by a transport nozzle arrangement that is optionally operated with gaseous and/or fluid transport media. Machines having this design can do with a relatively low draw-off height, along the length of which the fabric strand must be lifted at the outlet of the material storage section up to its entry into the transport nozzle. In so doing, the pulling forces exerted on the circulating fabric strand are appropriately lower in this region, this being advantageous in the treatment of sensitive textile fabrics.

Depending on the type of textile fabric to be treated, machines of different designs are used in practical applications. For example, in the case of highly sensitive textile fabrics, machines are used with transport sections arranged above the fabric strand storage in overflow mode. The nozzle gaps of the transport nozzles used here are relatively large and the nozzle pressures of the transport medium flow are correspondingly low. The fabric strand velocity is approximately 100 meters to 200 meters/min. On the other hand, the treatment of textile fabrics requiring a high fabric stand velocity necessitates high transport medium pressures with relatively small nozzle gaps in such machines. Typical fabric velocities in this case are approximately 200 meters to 600 meters/min. Therefore, transport nozzles having different nozzle cross-sections are used in the treatment of textile fabrics having different material weights. However, changing transport nozzles is very time-consuming and/or expensive.

Publication DE 37 34 260 C1 discloses a wet treatment apparatus for textile fabric in strand-form comprising a nozzle unit arranged in a treatment container, in which case the size of the width of the slits of the nozzle unit intended for introducing the treatment bath can be adjusted as well as the size of the free cross-section of the nozzle unit disposed for the centered feedthrough of the textile fabric, and the treatment bath can be adjusted across its inside width. However, the adjustment of the width of the slits of the nozzle unit usually referred to as nozzle gaps, as well as the cross-section of the nozzle unit, can be adjusted only within a relatively small design-specified ratio. The setting of a large cross-section and a small nozzle gap for a fabric strand of a heavy textile fabric circulating at high velocity is as problematic as the adjustment of a large nozzle gap in conjunction with a small cross-section, as is required for an overflow treatment of a light-weight textile fabric. Furthermore, only two of the four sides of the rectangularly configured nozzle unit are provided with a nozzle gap or slit. As a result of this, the pulling action of the nozzle unit on the passing fabric strand is limited. In a device for the treatment of strand-shaped textile fabric known from publication DE 10 2007 036 408 B3 in the form of a long storage machine there is provided a transport nozzle arrangement to which can be applied a gaseous transport medium flow, so that the device operates consistent with the aerodynamic principle. The transport nozzle arrangement comprises a venturi transport nozzle with a cylindrical transport nozzle housing in which a nozzle ring gap is formed, which subjected to a transport gas flow by a blower unit. The radial width of the nozzle ring gap can be changed by axially sliding back and forth a molded nozzle part in the transport nozzle housing. The nozzle ring gap is radially delimited on the inside and in the form of an arc of a circle on the outside. It is adjoined by an essentially cylindrical mixing section for the treatment agent or treatment bath flows and the transport gas flows. A basically similar transport nozzle configuration with adjustable nozzle ring gap for so-called short storage machines has been known from publication EP 1 985 738 A1. These are so-called high-temperature (HT) piece dying machines comprising a treatment container in the form of a pressure-resistant, essentially cylindrical, vat in which the fabric strand storage is consistently U-shaped with upward pointing limbs. The fabric strand that is continuously removed from the storage by means of a reel is moved through a venturi transport nozzle and via a transport section downstream of the transport nozzle to a fabric inlet side into the storage. The machine operates with a gaseous transport medium flow, i.e., consistent with the aerodynamic principle. This configuration of the transport nozzles having a circular nozzle gap is not optimal for the treatment of certain light-weight textile fabrics, in particular in the case of machines operating consistent with the hydraulic principle.

Considering this prior art, it is the object of the invention to provide a device of the aforementioned type that is distinguished by a broad spectrum of its fields of use in that said device allows the achievement of optimal transport conditions with fabric strands of different textile fabrics, without requiring greater constructional modifications or refitting of the machine.

In order to achieve this object, the device according to the invention exhibits the features of Patent Claim 1.

In the new device, the transport nozzle arrangement comprises a transport nozzle with a polygonal nozzle inlet opening and a polygonal outlet opening for the fabric strand, said outlet opening having appropriately adapted dimensions, between which a nozzle gap for the transport medium is delimited. This nozzle gap is adjustable and, furthermore, delimited on at least one side by straight nozzle elements all around, said nozzle elements having a substantially part-cylindrical cross-sectional shape.

The term "part-cylindrical cross-sectional shape" is understood to mean cross-sectional configurations that are not restricted to more or less constant-radius cylindrical shapes but it generally covers convex bead-like structures, whose surface delimiting the nozzle gap is curved in the manner of a cylinder having any desired cross-sectional shape.

In a preferred embodiment the nozzle gap tapers conically in flow direction, while the nozzle inlet opening for the fabric strand may be rectangular or square, which applies equally to the cross-section of the outlet part. Due to this polygonal configuration of the nozzle inlet opening that continues in the adjoining transport tube section of the transport section, a uniform transport of the fabric strand is achieved in the region of the transport nozzle working consistent with the venturi principle. As it is, it has been found that, in the event of a circular configuration of the cross-section of the transport tube of the transport section adjoining the corresponding circular nozzle inlet opening, certain light-weight textile fabrics tend—among other things—to be compressed, due to the force of gravitation, in the lower, tapering part of the cylindrical transport tube with the result that longitudinal marks and stripes may form in the fabric strand that is moving through. In the event of a square or rectangular configuration of the nozzle inlet opening and the cross-section of the adjoining transport tube section, the fabric strand glides at least over a considerable part of its width on a plane surface on which it lies due the effect of gravity. The width of this plane surface can be selected appropriate for the intended purpose, taking into consideration the textile fabric that is to be treated. Basically, pentagonal and polygonal cross-section shapes are also possible, as long as the flat support surface for the fabric strand moving over it is wide enough for uniformly supporting the fabric strand across its width, without crowding it.

In this new device the nozzle gap is adjustable so that, depending on the type of textile fabric to be treated, the nozzle gap width most favorable for the treatment can be selected. Consequently, the device can be operated in overflow mode as well as at high fabric strand velocity, without requiring the exchange of any nozzle components or any other refitting.

The straight nozzle elements surrounding the nozzle inlet opening result in optimal inflow conditions for the transport medium in the nozzle gap and the nozzle inlet opening. The nozzle gap that tapers conically toward the transport medium exit point from the nozzle gap achieves a clearly better degree of efficacy than a transport nozzle of the supply wall to the nozzle gap that is delimited by parallel lateral walls. Due to this conical configuration, a jet constriction as well as cavitation phenomena as are occasionally observed in conventional nozzles in hydraulic operation are prevented. These cavitation phenomena are due to the fact that between walls that are more or less parallel to each other and that laterally delimit the nozzle gap, there occur zones with excess fluid velocity that trigger cavitations.

As a result of the aforementioned possibility of an independent adjustment of the treatment intensity by appropriate adjustment of the nozzle gap, it is possible to perform intense jet treatments and gentle overflow treatments without nozzle change in the case of light-weight and heavy textile fabrics.

The invention is suitable for long storage machines as well as for short storage machines. Its transport nozzle arrangement operating consistent with the venturi principle can be disposed for the operation with gaseous and/or fluid transport medium flows.

Figure 2:
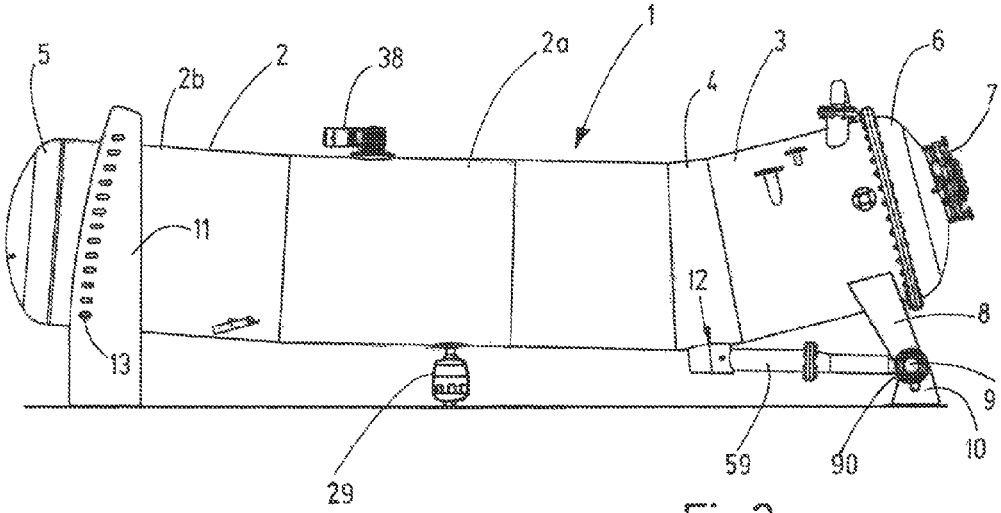
Figure 3:
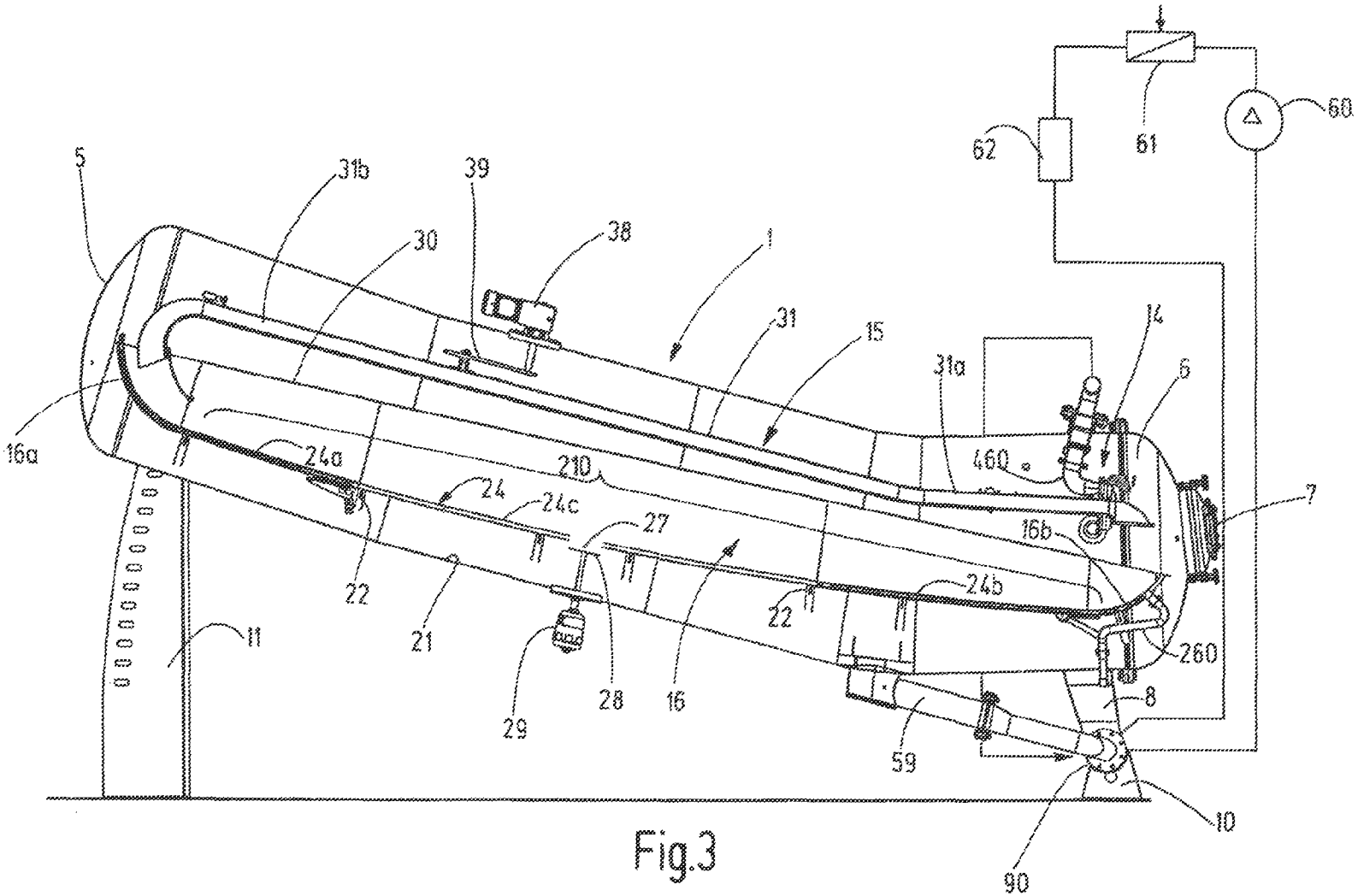
Figure 4:
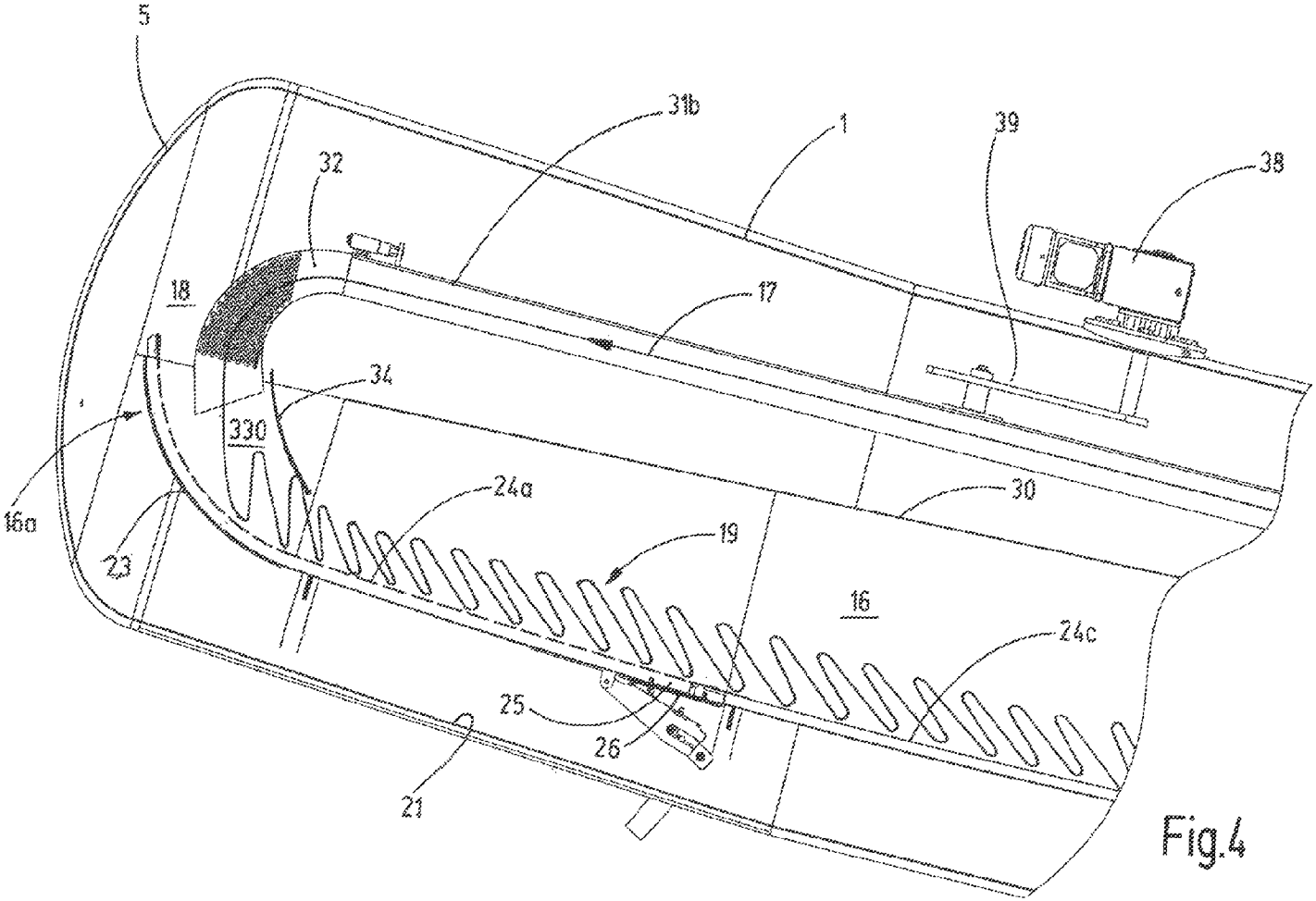
Figure 5:
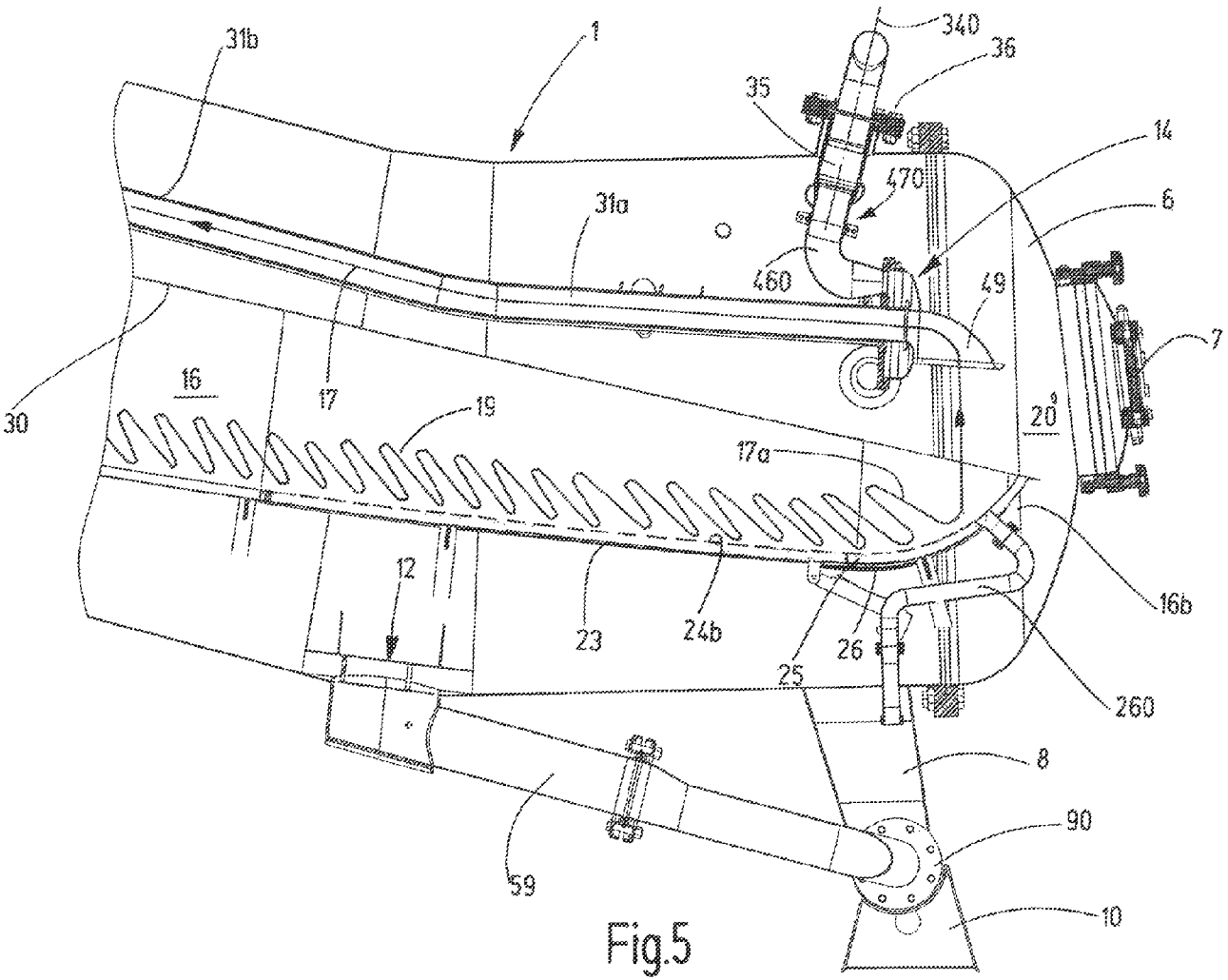
Figure 6:
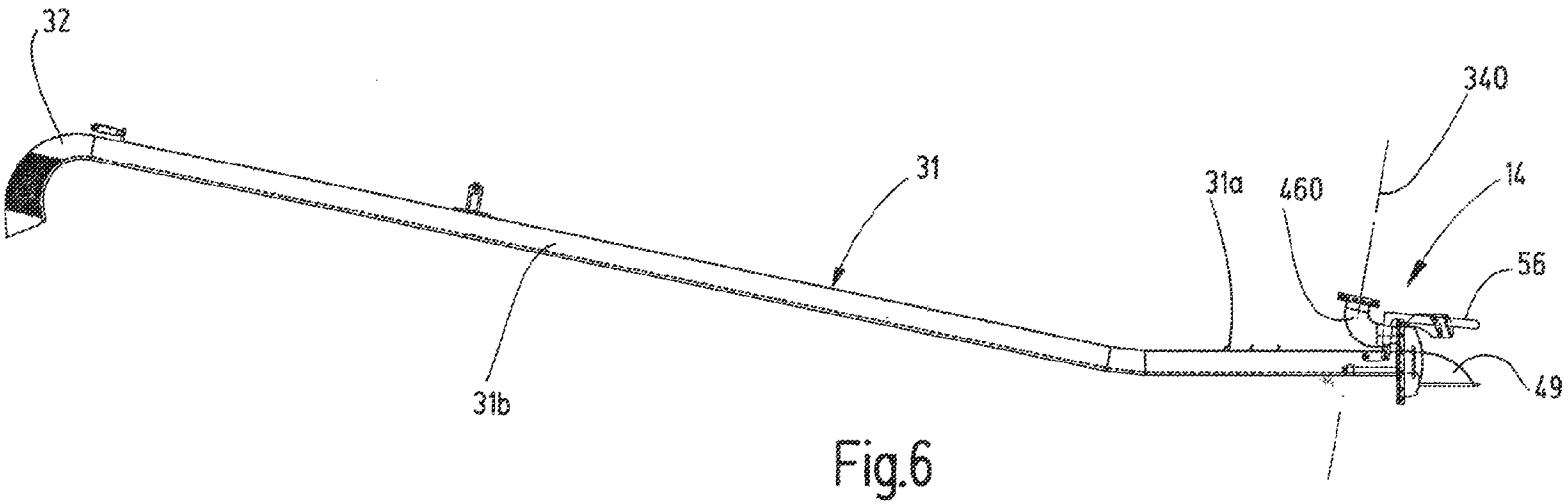
Figure 7:
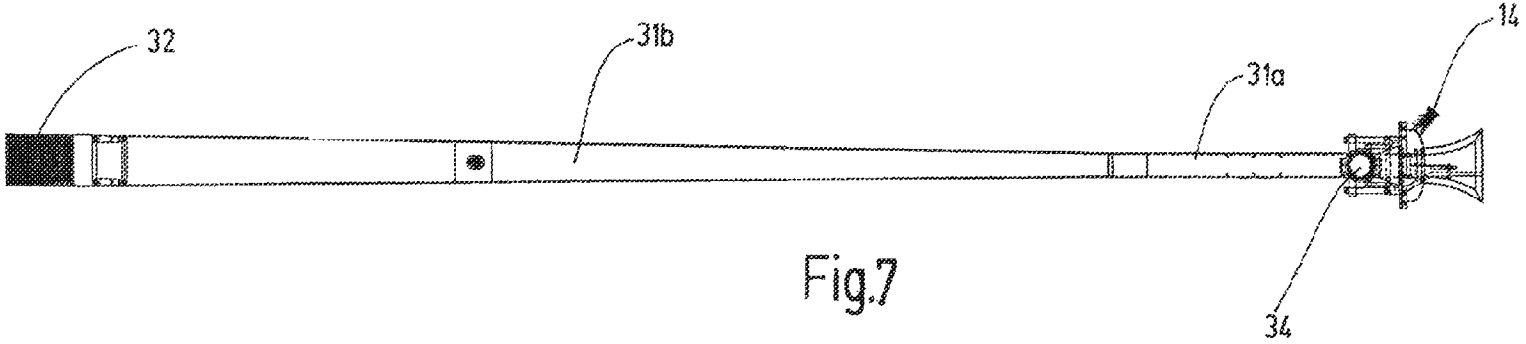
Figure 8:
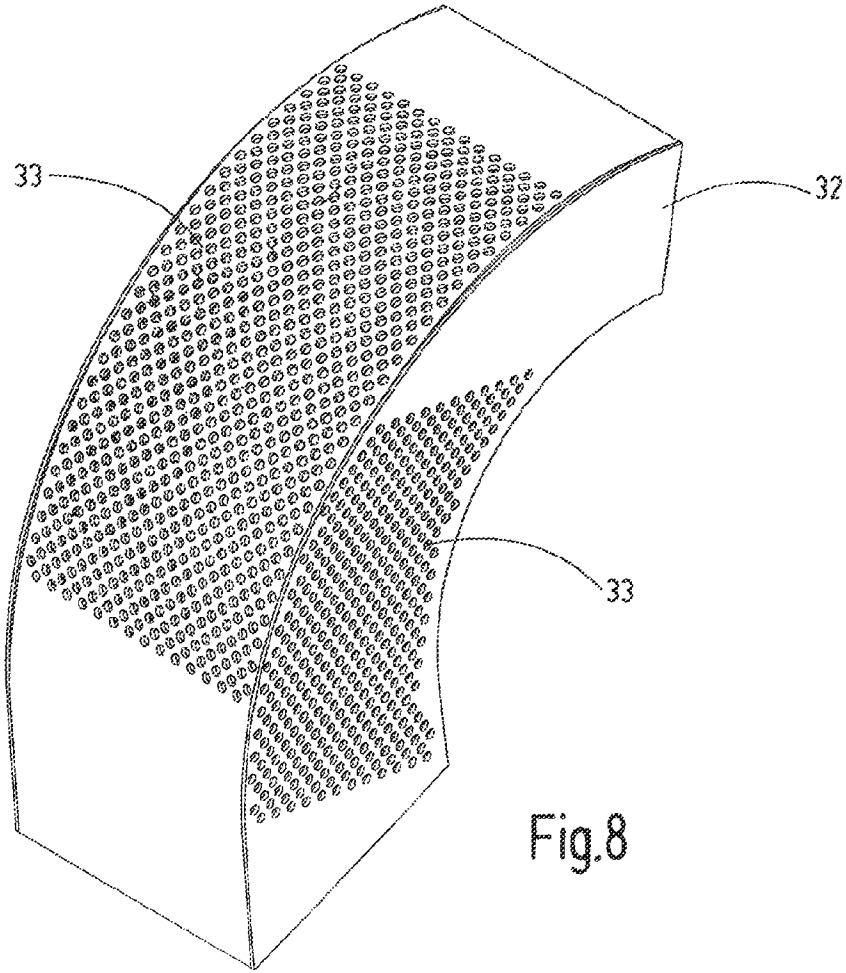
Figure 9:
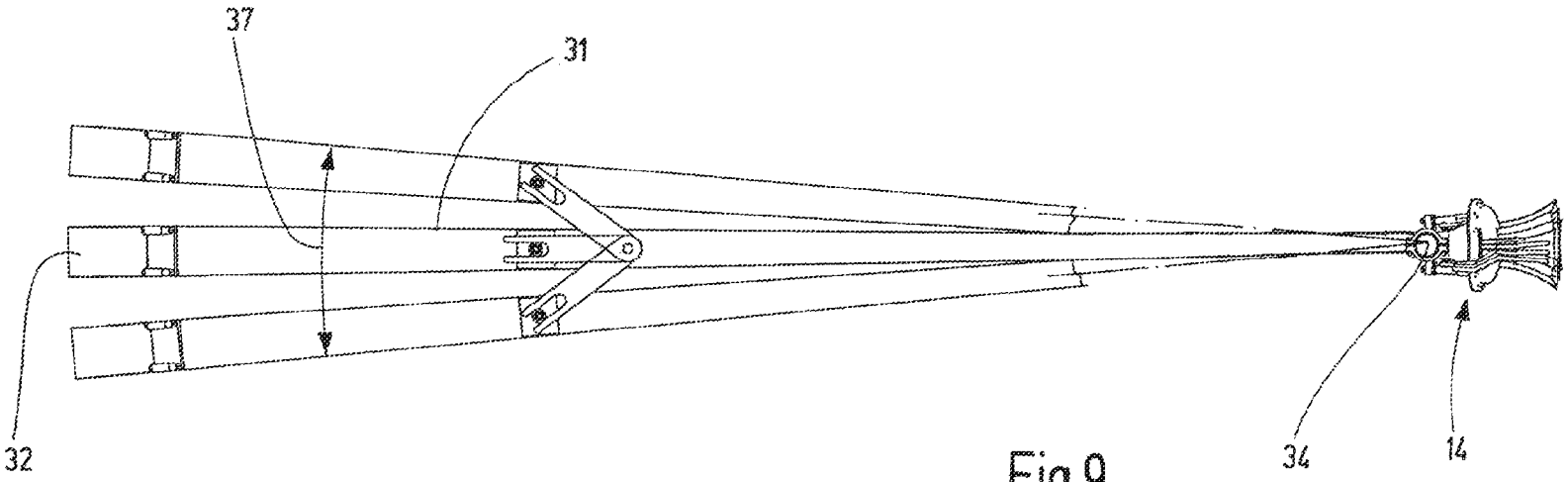
Figure 10:
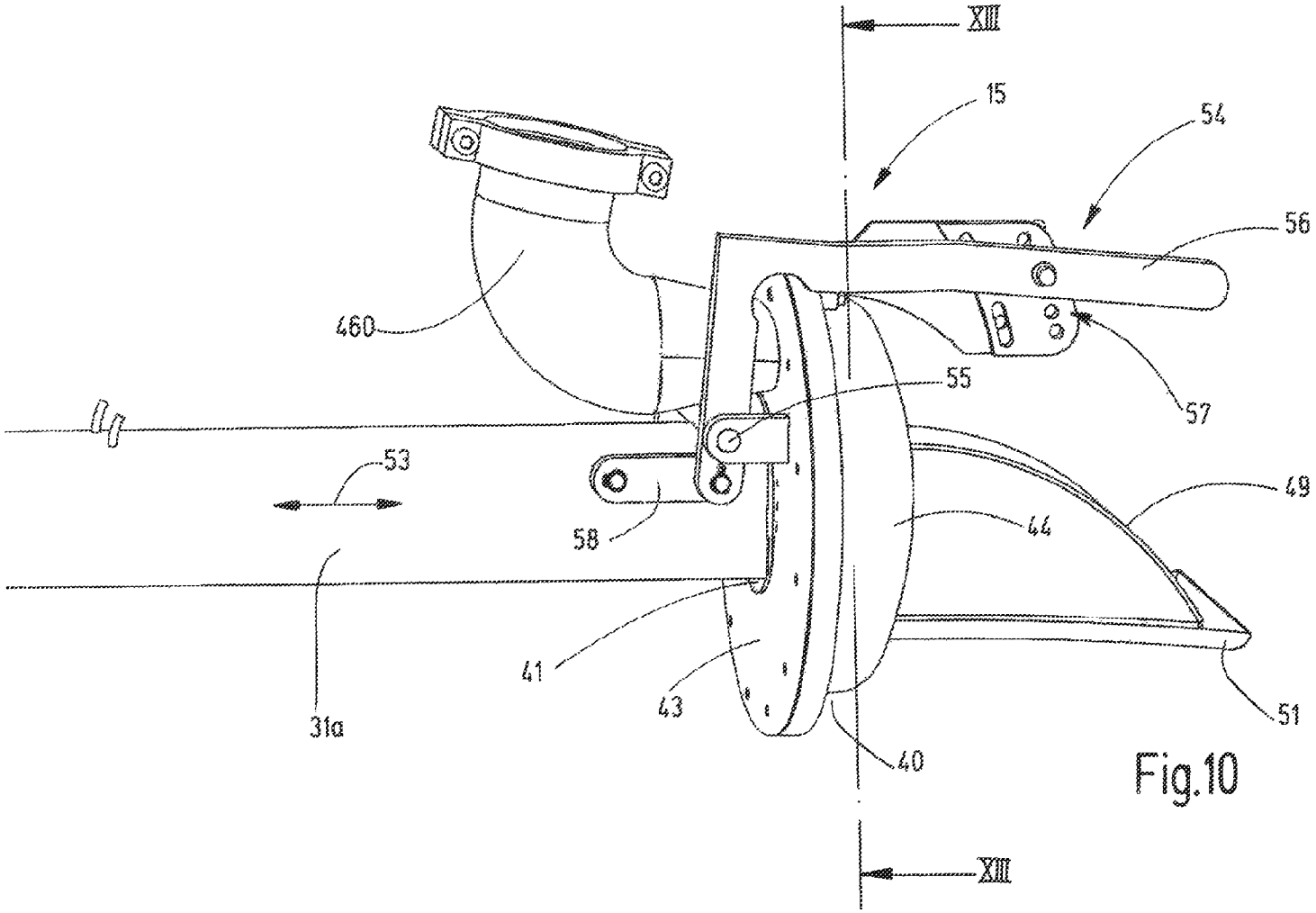
Figure 11:
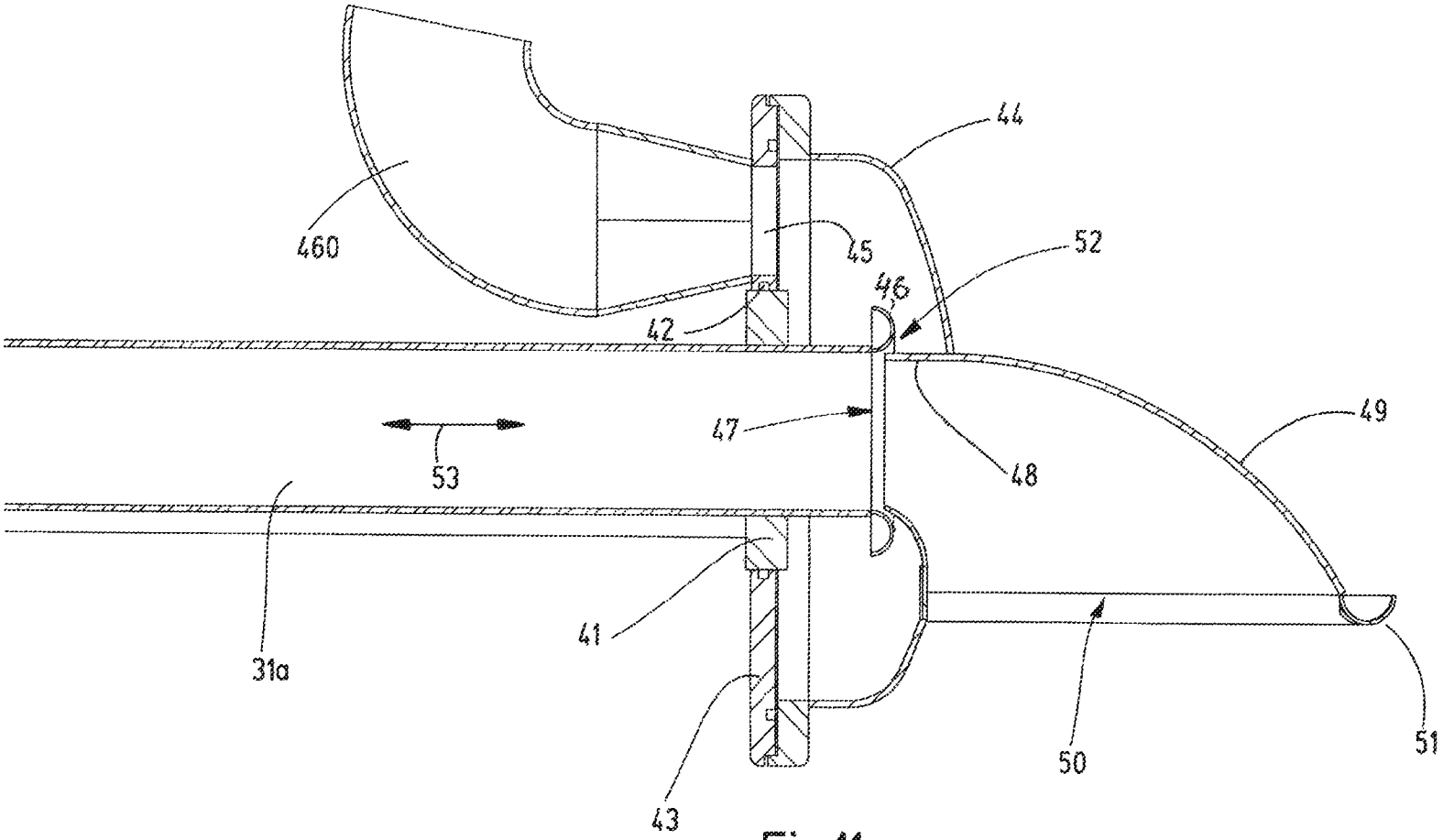
Figure 12:
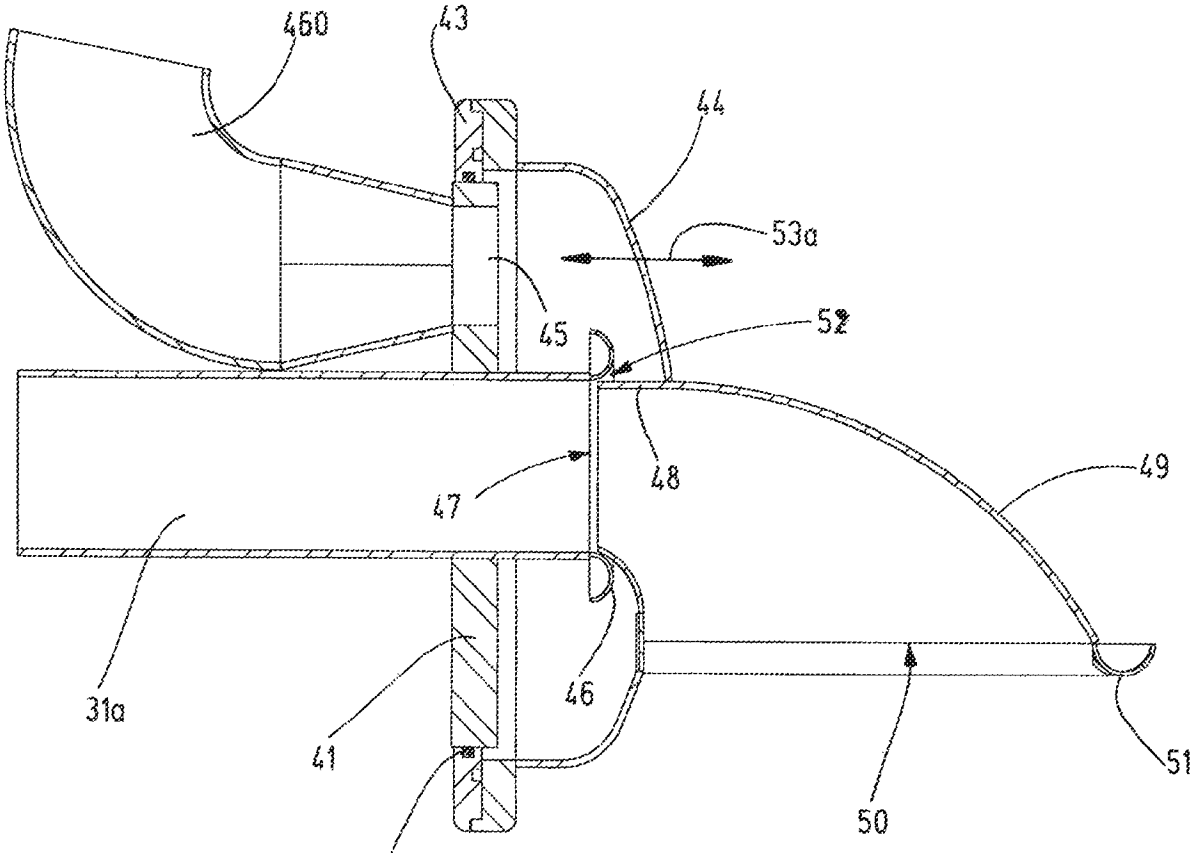
Figure 13:
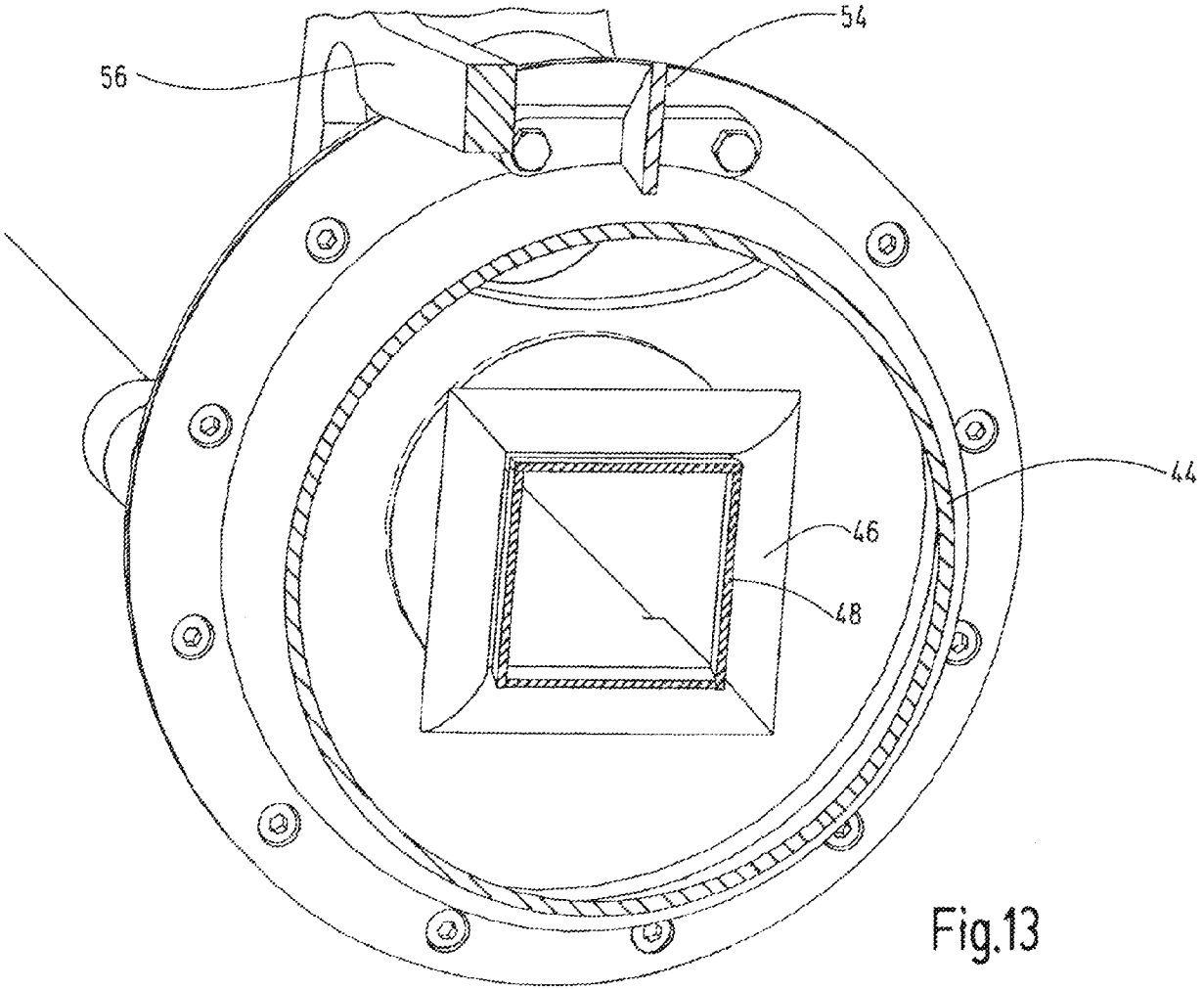
Figure 14:
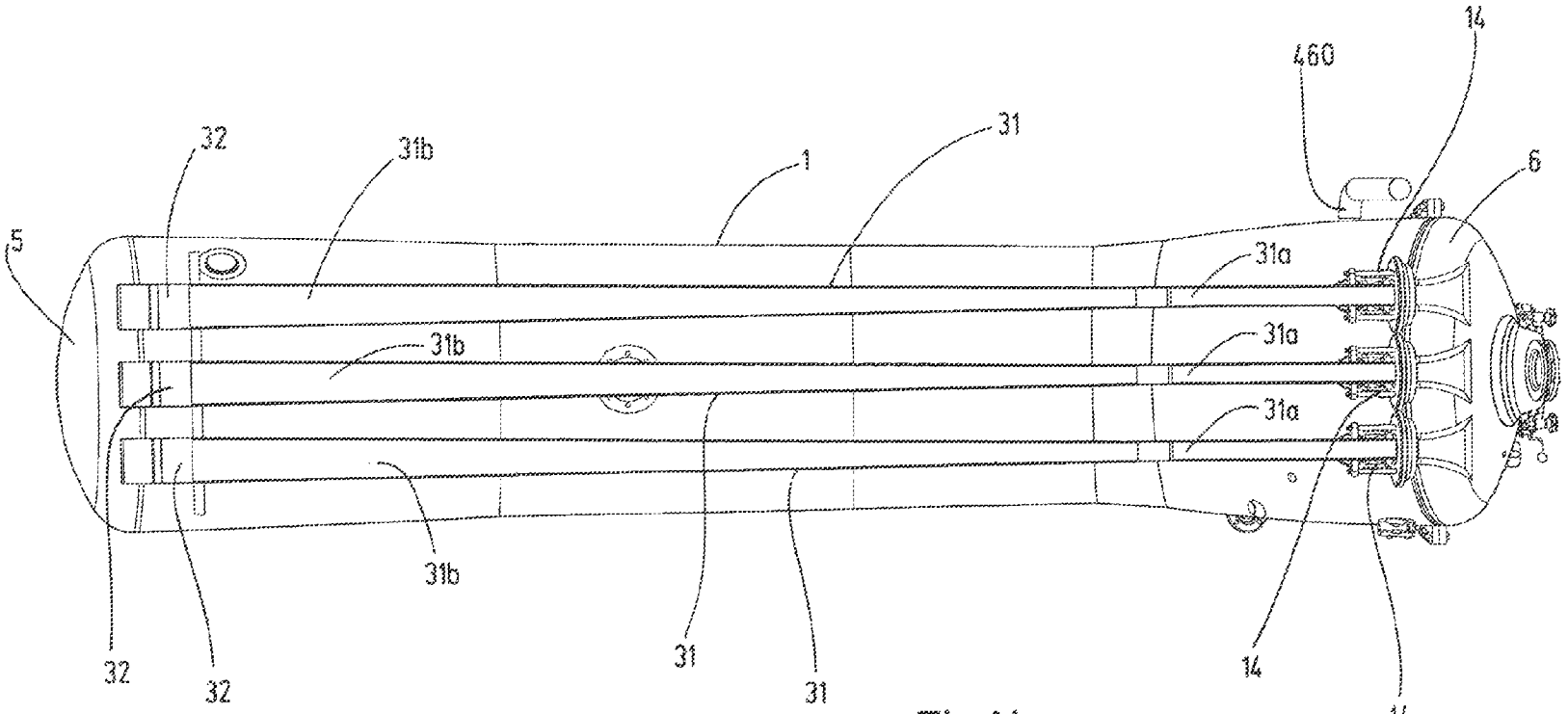

Additional embodiments of the device of the present invention are the subject matter of dependent claims. They show in FIG. 1 a schematic representation of a long storage machine according to the invention, in a side view with the treatment container pivoted up;

FIG. 2 a corresponding side view of the long storage machine as in FIG. 1, with the treatment container lowered;

FIG. 3 a longitudinal section of the long storage machine as in FIG. 1, in a side view;

FIG. 4 a cutout of the long storage machine as in FIG. 3, in an enlarged side view, illustrating the fabric strand inlet side of the storage section;

FIG. 5 a cutout of the long storage machine as in FIG. 3, in an enlarged side view, illustrating the fabric strand outlet side of the storage section;

FIG. 6 a side view of the transport section of the long storage machine as in FIG. 2, in another scale;

FIG. 7 a plan view of the transport section as in FIG. 6;

FIG. 8 a perspective partial representation of the fabric strand outlet elbow of the transport section as in FIG. 6, in another scale;

FIG. 9 a plan view of the transport section as in FIG. 7, illustrating the pivot range of the transport tube;

FIG. 10 a perspective partial representation of the transport nozzle arrangement as in FIG. 2, in another scale;

FIG. 11 a schematic side view of the transport nozzle arrangement as in FIG. 10, in a schematic longitudinal section along line XI-XI of FIG. 10;

FIG. 12 the transport nozzle arrangement as in FIG. 11 in another embodiment and in a corresponding sectional view;

FIG. 13 a partially perspective view of the transport nozzle arrangement as in FIG. 11, in longitudinal section along line XIII-XIII of FIG. 11, and in a detail; and FIG. 14 a partially cut open plan view of a long storage machine as in FIG. 1, and in a modified embodiment as a multi-strand machine.

The long storage machine depicted in FIGS. 1 to 3 is disposed for the treatment of strand-shaped textile fabric in the form of an endless fabric strand that is set in circulation at least during part of the treatment.

The machine comprises an elongated, substantially tubular treatment container 1 that consists of a longer cylindrical tubular section 2 and a shorter, likewise cylindrical, tubular section 3 having the same diameter, these being connected to each other via a wedge-shaped intermediate tubular piece 4 and being closed on the end sides with bottoms, for example torispherical ends or basket elbow ends 5, 6. The removably mounted basket elbow end 6 is provided with a loading door 7 leading into the interior of the container. The axes of the two tubular sections 2, 3 include between them an oblique angle of 165 degrees. On its front end, the treatment container 1 is supported by two feet 8 mounted to opposite sides on the tubular section 3, said feet being supported by stationary bearing brackets 10 so that it can be pivoted about a horizontal axis of rotation 9.

On the back end of the treatment container 1, there is provided a lifting device that is schematically represented at 11 and is in contact with the outside of the longer tubular section 2, said lifting device working with a not specifically illustrated lifting spindle or with likewise not illustrated lifting cylinders and forming adjustment means for the treatment container 1. By means of the lifting device 11, it is possible to pivot the treatment container 1 about its axis of rotation 9, so that the inclination of the treatment container is changed relative to the horizontal, for example, between the position as in FIG. 1 in which the short tubular section 3 is oriented approximately parallel to the horizontal and the position as in FIG. 2 in which the substantially straight center part 2*a* of the longer tubular section adjoining the intermediate tubular piece 4 is either oriented exactly parallel or at a smaller residual inclination relative to the horizontal. As can be inferred from FIGS. 1, 2, an end part of the longer tubular section 2*b* of the longer tubular section 2 bearing the torispherical end 5 is pivoted upward relative to the adjoining tubular section 2*a* about a small axial angle of approximately 10 degrees, so that—in the lowered position of the treatment container as in FIG. 2—fluid contained in said treatment container gathers on the container bottom at a lowest point 12 in the region of the intermediate tubular piece 4 and can be removed from this lowest point.

As a rule, the inclination of the treatment container 1 is adjustable by appropriate pivoting about the axis of rotation 9 within a range of 6 degrees to 14 degrees; however, in the event of special cases of use, other, in particular larger, adjustment ranges are also conceivable. In its respectively set position of inclination, the treatment container 1 can be locked by adjustment means of the lifting device 11 as is indicated by catches 13. The adjustment of the inclination of the treatment container 1 may also be done in a continuous manner.

In the treatment container 1, as is particularly obvious from FIG. 3, there are arranged a transport nozzle arrangement 14, an adjoining transport section 15 and a trough-shaped or tub-shaped, elongated gliding bottom 16, these allowing that an endless fabric strand schematically indicated at 17 in FIGS. 4, 5 can be put into circulation. The fabric strand sucked up by the transport nozzle arrangement 14 moves through the transport section 15 to the fabric strand inlet side 18 (FIG. 4) of a storage section 210 of the treatment container 1 accommodating a plaited fabric strand pile as indicated at 19, in which treatment container extends from the fabric strand inlet side 18 to a fabric strand outlet side 20 (FIG. 5) the gliding bottom 16 receiving the folded fabric strand pile 19.

The gliding bottom 16 extends in the treatment container 1 at a distance above the container wall 21 located below and is firmly supported by holders 22 mounted to the container wall. If the inclination of the treatment container is changed by being pivoted about the axis of rotation 9, consequently also the inclination of the gliding bottom 16 is correspondingly changed relative to the horizontal. Alternatively, other embodiments are also conceivable, wherein also the gliding bottom 16 in the treatment container 1 is supported by holders 22 that are height-adjustable and thus allow a changing of the inclination of the gliding bottom 16 relative to the container wall 21, while the treatment container 1 itself maintains its once-set inclination.

The tub-shaped gliding bottom 16, which is configured on its inside walls facing the passing-through fabric strand pile 19, so as to display a low coefficient of friction relative to the fabric strand pile and is coated—for example with Teflon—or provided with special gliding elements or rollers, is made of two walls with a fluid-impermeable outside wall 23 and—at a distance therefrom—an inside wall 24 that is perforated in a section 24*a* extending from the fabric strand inlet side 18 and in a section 24*b* leading to the fabric strand outlet side 20 and is fluid-impermeable in a wall section 24*c* located in between. The perforated sections 24*a*, 24*b* are highlighted in black in FIG. 3. On their ends, there are provided fluid discharge openings 25 (FIGS. 4, 5) that are closed by closure caps 26 which can be selectively opened in order to be able to drain treatment fluid passing through the perforated inside wall sections 24*a*, 24*b* into the treatment container 1.

A filling pipe 260 terminates in the tub-shaped gliding bottom 16 and allows filling of the gliding bottom in the course of a treatment container adjustment as in FIG. 2 with treatment fluid, in which case the gliding bottom is oriented essentially in horizontal direction and the closure caps 26 are closed. Filled treatment fluid can ultimately be drained through a discharge opening 27 into the interior of the container. The fluid passage through the discharge opening 27 is controlled by a closure member 28 in such a manner that it can be actuated by an actuator 29 that can be controlled from the outside.

The gliding bottom 16 is curved concavely along is length that accommodates the fabric strand pile 19, preferably consistent with an arc of a circle having a large radius (for example 20 meters) or consistent with a catenary line. In so doing, the discharge opening 27 is arranged at the lowest point of the gliding bottom 16 with the gliding bottom being oriented horizontally. Adjoining this concavely curved section, the gliding bottom 16 is highly arched on the fabric strand inlet side 18 and on the fabric strand outlet side 20 at 16*a* and 16*b*, respectively, in which case the high arch 16*a* extends into the region of the center axis of the treatment container. The adjoining bordering edge of the lateral wall of the tub-shaped gliding bottom 16 is indicated at 30.

The transport section 15 above the gliding bottom 16 in the treatment container 1 comprises a transport tube 31, the details of which can be seen in FIGS. 6, 7, in particular. Starting at a short, straight tubular section 31*a* having a constant square diameter and being connected to the transport nozzle arrangement 31, the transport tube 31 has, in a long section 31*b*, a conical expansion of the flow channel formed by the transport tube, with the cross-sectional shape of said channel thus becoming increasingly rectangular. On the end of the transport tube section 31*b* facing the transport nozzle arrangement 14, there follows a fabric strand outlet elbow 32 having a rectangular cross-section, the details of said elbow being obvious from FIG. 8. The material stand outlet elbow 32 extends over approximately 90 degrees and is provided with a perforation 33 in the region of its lateral walls and in at least its radial outside wall. It terminates in the manner that can be inferred from FIG. 4 in the gliding bottom 16 on the fabric strand inlet side 18 of said gliding bottom. Below the perforated fabric strand outlet elbow 32 there is, in the gliding bottom 16, a fabric strand depositing zone 330 (FIG. 4) having a width corresponding approximately to the width of the gliding bottom 16 and having a depth that is only 150 mm to 200 mm. This depositing zone 330 is delimited toward the inside of the treatment container by a boundary wall 34 (FIG. 4) that is arcuate, extends over the width of the gliding bottom 16 and extends downward toward the inside wall 24*a* of the gliding bottom 16 up to a specified distance. The fabric strand depositing zone 330 is thus delimited on all four sides by walls, in which case the highly arched section 16*a* extends in lateral direction relatively closely to the fabric strand outlet elbow 32. The tube section 31*a* could also be configured so as to have a constant rectangular or polygonal cross-section.

Feeding of the fabric strand on the back side of the fabric strand depositing zone 330 over the height of approximately 150 mm to 200 mm—together with the boundary wall 34—imparts a pulse to the fabric strand 17 moving into the gliding bottom 16, said pulse causing the fabric strand to be deposited at the beginning of the storage section in superimposed layered folds in such a manner that the fabric strand 17 on the fabric strand outlet side 20 is always drawn off the uppermost layer 17*a* of the fabric strand pile as is illustrated in FIG. 5. As indicated in FIGS. 4, 5, the fabric strand pile 19 is constructed on the fabric strand inlet side 18 in such a manner that later deposited textile fabric comes to lie under the fold of the previously deposited textile fabric, i.e., the folds of the strand in the fabric strand pile 19 are arranged so as to be inclined toward the fabric strand inlet side 18 and remain in this basic position when passing through the storage section. In this manner, an excellent fabric strand movement is achieved while—when the fabric strand is being drawn off on the fabric strand outlet side 20—there is no risk that undesirable fabric strand loops, etc., are forming.

On entering the fabric strand depositing zone 330 the fabric strand 17 is folded across the width of the tub-shaped gliding bottom 16 such that the fabric strand outlet elbow 32 is imparted with an oscillating uniform movement via the transport tube 31. For this purpose, the transport tube is supported so that it can be pivoted together with the transport nozzle arrangement 14 about an axis of rotation 340 (FIGS. 5, 9) extending through a straight tube connecting piece 35 of the treatment agent supply line 470 to the transport nozzle arrangement 14. The tube connecting piece 35 is rotatably supported in a sealed manner at 36 in a rotating bearing mounted to the treatment container 1. The pivot range of the transport tube 31 can be inferred from FIG. 9, where, on the side with the transport tube 31 in a center position, the two end positions of the transport tube 31 located on both sides of this center position are illustrated, while the pivot range is indicated by an arrow 37.

Due to the relatively great length of the transport tube 31, the fabric strand outlet elbow 32 leads to a uniform, almost linear movement across the width of the depositing zone 330 during the fabric strand depositing process. As a result of this, a very gentle deposition of the fabric strand in the depositing zone 330 is achieved, which is of advantage with highly sensitive textile fabrics, in particular. This is in contrast with such known embodiments of folding arrangements wherein a fabric strand outlet elbow is imparted with a rotary movement about the axis of the transport tube that causes a corresponding twisting of the fabric strand that passes through, thus potentially resulting in difficulties affecting a variety of sensitive textile fabrics.

The oscillating pivoting motion is applied to the transport tube 31 by a drive motor 38 (FIG. 3) attached to the treatment container 1, said motor being connected via a link mechanism 39 in such a manner that the transport tube 31 is moved back and forth at uniform speed over its pivot range 37.

As a result of the fact that the entire transport section 15 is arranged together with the transport nozzle arrangement 14 inside the treatment container 1, there results the advantage that the transport tube 31 does not need to be pressure-resistant and thus can be manufactured in a relatively simple and cost-effective manner. As can be learned from FIG. 3, the transport section 15 and the transport nozzle arrangement 14 may be configured with height dimensions that are so minimal that these can be removed and inserted again through the opened loading opening at 7.

With its tubular section 31*a* having a constant square cross-section along its length, the transport section 15 is connected to a transport nozzle 40 of the transport nozzle arrangement 15, the precise design of which can be inferred from FIGS. 10 through 13, in particular:

Attached to the tubular section 31*a* is a cylindrical housing panel 41 that is peripherally shiftable in an axially delimited manner and is moved in a fluid-tight manner sealed by gaskets 42 in a housing ring flange 43 of a nozzle housing 44. The ring flange 43 has an inlet opening 45 for the treatment fluid that can flow via a tubular elbow 460 of the treatment fluid supply line 470 (FIG. 5) into the nozzle housing 44. Extending into the nozzle housing 44 is the tubular section 31*a* having a square cross-section, said section 31*a* being provided—at an axial distance from the housing panel 41—on the edge side—with four straight nozzle elements 46 (FIGS. 11, 13). Each of the nozzle elements 46 is substantially bent in a semi-cylindrical form and extends over the length of the lateral wall of the tubular section 31*a*, in which case the four nozzle elements 46 are connected to each other at the ends in a manner obvious from FIG. 13 so as to abut against each other. Thus results a nozzle opening 47 that is delimited in a straight line on all sides by cylindrical surfaces. In alignment with this nozzle inlet opening 47 is the outlet part 48 of a funnel-shaped fabric strand inlet elbow 49 leading into the nozzle housing 44 and being connected therewith in a fluid-tight manner, said outlet part being appropriately adapted in view of its dimensions and having a square cross-section. The fabric strand inlet elbow 49 has an essentially rectangular fabric strand inlet opening 50 that is also delimited by essentially semi-cylindrically bent guide surfaces 51, as can be seen in FIGS. 10, 11.

Between the nozzle elements 46 having the semi-cylindrical cross-section and surrounding the nozzle inlet opening 47 and the outlet part 48, there is delimited a nozzle gap 52 via which the treatment fluid fed through the treatment fluid supply line 470 enters into the tubular section 31*a* of the transport tube 31. Due to the cylindrical form of the nozzle elements 46 and the configuration of the fabric strand outlet opening of the outlet part 47 adapted so said form, an essentially eddy-free introduction of the treatment fluid through the conical nozzle gap 52 into the nozzle inlet opening 47 is achieved. In contrast with the conditions of a design of the nozzle gap delimited by more or less parallel surfaces or the abrupt embodiment of the nozzle gap, in this case largely laminar flow conditions are achieved that—even at high treatment temperatures—avoid cavitations or similar phenomena that are detrimental to the transport of the fabric strand.

The opening width of the nozzle gap 52 can be adjusted in that, in the embodiment as in FIG. 11, the entire transport section 15 is axially adjusted in the direction of the arrow 53. For this purpose, an adjustment mechanism 54 (FIG. 10) is provided on the transport nozzle 40, said adjustment mechanism comprising an L-shaped adjustment lever 56 having a ring flange 43 pivotally supported at 55, the respectively selected angular position of said adjustment lever being lockable in place by means of catches 57. The adjustment lever 56 is connected, via a clip 58 forming a part of the adjustment mechanism in a hinged manner, to the tube section 31*a* in such a manner that a pivoting movement of the adjustment lever 56 about the pivot axis at 55 is effected by an axial oscillation of the tube section 31*a* as indicated by the arrow 53, and thus the entire transport tube 31.

The adjustment lever 56 may be manually actuated or via a not specifically illustrated actuator of a control device. It allows the selective changing of the nozzle gap 52 that tapers conically toward the outlet opening from the nozzle housing 44. In this manner, it is possible to change the intensity of the treatment of the passing fabric strand with the treatment fluid between a more intensive treatment (narrow nozzle gap) and a more gentle treatment (large nozzle gap).

In an alternative embodiment illustrated by FIG. 12, the nozzle housing 44 can be adjusted back and forth in tube axis direction consistent with the arrow 53*a* for the adjustment of the nozzle gap 52 relative to the transport tube 31—and thus its tube piece 31*a*—that cannot be adjusted back and forth in axial direction. The corresponding adjustment mechanism is not specifically illustrated in FIG. 12. Basically, its design is similar to that shown by FIG. 10. Other than that, parts that are the same as or similar to those in FIG. 11 have the same reference signs, so that—to this extent—it is not necessary to explain them again. In this case, the inlet opening 45 is arranged in the housing panel 41. The embodiment of FIG. 11, as well as that of FIG. 12, is provided with an anti-twist protection between the housing panel 41 and the ring flange 43 so that a twisting between the parts 48 and 46, 31*a* delimiting the nozzle gap 52 may not occur.

The long storage machine described so far operates as follows:

In the known long storage machines, most textile fabrics are treated at a relatively long bath ratio of, e.g., 1:8 to 1:5, which necessitates great expenses and effort in view of energy, chemicals and reactive dyes.

As opposed to this, the hydraulically operating long storage machine is designed for the smallest possible bath ratios that are on the order of 1:3 for synthetic materials and of 1:4 for cotton materials.

The fabric strand 17 to be treated is introduced in a customary manner—with the treatment door 7 open—into the treatment container 1 that is designed as a pressure-resistant vat and, in so doing, said fabric strand is sucked through the fabric strand inlet elbow 49 by the transport nozzle arrangement 14. The transport nozzle arrangement 14 is loaded with treatment fluid that, among other things, is optionally evacuated by a pump 60 via a drain line 59 (FIG. 3) originating at 12 from the treatment container, which container has a rotary feedthrough 90 having an axis of rotation 9 arranged in one of the two feet 8. The pump 60 conveys the treatment fluid over a heat exchanger 61 and a lint filter 62 of the bath supply line 470 to the transport nozzle arrangement 14. The tube connection between the supply line 470 and the pressure side of the pump 60 occurs via a rotary feedthrough having an axis of rotation 9 arranged in one of the two feet 8, which is not specifically illustrated in the drawing (FIG. 3), while the drain line 59 is connected to the suction side of the pump 60 via the rotary feedthrough 90. The treatment agent addition vessels and arrangements are not specifically illustrated.

After the ends of the strand have been sewn to each other and after closing the loading door 7, the fabric strand 17 may be treated in the—optionally pressurized—treatment container 1 with the treatment fluid that has been brought to the required temperature. In so doing, the long storage machine allows the operation—depending on the requirements of the textile fabric—in wet mode, in semidry mode or in dry mode.

The fabric strand is circulated by the transport nozzle arrangement 14, transported through the transport section to the fabric strand inlet side 18 into the treatment container 1 and introduced there into the tub-shaped gliding bottom 16 via the fabric strand outlet elbow 32 in the depositing zone 330, where said fabric strand is stored in the storage section in the form of the fabric strand pile 19 and conveyed to the fabric strand outlet side 20. Here, it is again sucked into the transport nozzle arrangement 14 after having passed through the so-called draw-off height.

Downstream of the transport nozzle 40 of the transport nozzle arrangement 14, the fabric strand first moves through the tube piece 31*a* having a constant cross-section and a length approximately five to ten times the width of the nozzle inlet opening 47. In this zone, the pulse of the treatment agent jet is applied at a high degree of efficiency to the textile fabric of the fabric pile. The pulling forces generated by the jet of the treatment fluid act on the passing fabric pile over a length of approximately 600 to 1000 mm with the result that a highly gentle treatment of the textile fabric with low pulling forces can be achieved.

Adjoining this intensive zone in the tube piece 31*a*, the transport tube 31 widens conically in its tube section 31*b*. In this tube section, the remaining flow energy of the treatment medium is transmitted to the fabric strand. At the same time, the textile fabric is opened through the conical expansion to the outlet width of the transport channel. The intensive zone in the tube section 31*a* and the conical expansion in the tube section 31*b* result in a very good pulling effect of the fabric strand transport system to act on the fabric strand. The low speed of the treatment fluid at the end of the transport section prevents impairments of the conveyed textile fabric, to which also contributes the circumstance that the pulling forces are transmitted to the fabric strand over a relatively long path of the transport section. The transport of the textile fabric in the transport tube 31 occurs in a floating manner. The transport section 15 is provided with an incline in order to bring the textile fabric to the upper position of the gliding bottom 16 and to the material slide created thereby. The cross-section of the transport tube 31 is rectangular which, compared with a cylindrical tube, provides the advantage that the textile fabric is not compressed on the tube bottom where it is supported, as is true of a cylindrical tube.

After passing through the transport tube 31, the textile rope enters the upper end of the perforated rectangular fabric strand outlet elbow 32 arranged on the upper end of the transport tube 31. Due to the centrifugal force and due to the residual pressure of the treatment agent, a large portion of the treatment agent carried along by the fabric strand is separated from the fabric strand and enters the back part of the treatment container 1. As the fabric strand velocity increases, a disproportionately large amount of the treatment agent is separated from the fabric strand. The released treatment agent splashes from the treatment outlet elbow 32 against the adjacent walls in the back part of the treatment container 1 and causes the cleaning of these walls in this manner. As a rule, the percentage of the thusly separated treatment fluid is at approximately 30 to 70%.

Below the perforated fabric strand outlet elbow 32, the fabric strand 17 enters the fabric strand depositing zone 330. This is relatively narrow and causes, in the already described manner, a controlled deposition of the fabric strand. Due to the special configuration of the walls and the boundary wall 34, the fabric strand is turned in such a manner while it is being deposited that, as already mentioned, the fabric strand is drawn off the uppermost fold 17*a* located at the lower end of the gliding bottom 16 on the fabric strand outlet side 20.

Treatment fluid that is still carried along is removed from the fabric strand pile 19 pushed forward on the gliding bottom 16 is discharged through the perforation in the gliding bottom sections 24*a*, 24*b* and allowed to flow off into the treatment container 1 with the flaps 26 open. Thus loading the fabric strand with treatment fluid is reduced to a very low value.

Combined with the short draw-off height of the fabric strand on the fabric strand outlet side 20, this low treatment fluid load of the fabric strand also results in a minimal pulling strength stress on the fabric strand on the way between the gliding bottom and the transport nozzle arrangement 14. Inasmuch as the transport nozzle arrangement 14 is not arranged in the ascending part of the fabric strand circulation path, i.e., adjoining the gliding bottom 16 and downstream of the fabric strand inlet elbow 49, but in the continuation of the straight tube section 31*a* of the transport section 14, highly favorable circulation conditions result for the fabric strand that is treated in a particularly gentle manner.

The textile fabric layer, i.e., the height of the fabric strand pile 19 on the gliding bottom 16, as a rule, ranges between 10 and 15 cm. In this manner, the compressive pressure acting at the lower end of the inclined gliding bottom 16 on the lowermost fabric strand fold is relatively low. As a result of the already described option of letting the free treatment fluid drop off, there is only the treatment fluid remaining in the loops or fabric interstices due to capillary action and adhesive forces. Therefore, the largest group of textile fabrics by far can be treated in the treatment container in the elevated position as in FIG. 1, in which the gliding bottom 16 is inclined accordingly. As a result of the uniformly curved shape of the gliding bottom 16, the density of the fabric strand pile—as has also already been explained—remains relatively low on the entire transport path through the storage section and thus, in particular, also in the lower-lying region in the vicinity of the fabric strand outlet side 20.

Referring to a particular group of textile fabrics (e.g., acetate) the compression of the fabric strand pile on the gliding bottom 16 is already too high when the treatment container is adjusted as in FIG. 1, so that folds and creases or other surface detriments may occur. Considering this group of articles, the inclination of the treatment container 1 can be reduced into the position as in FIG. 2, so that the tub-shaped gliding bottom 16 is filled with treatment agent and the textile fabric is treated therein in a floating manner. The space under the gliding bottom 16 remains loaded with a gas/air vapor mixture below the perforated wall 24*a, b* because of the wall 23 that acts as a bath collector. Consequently, the bath ratio in this operating mode is considerably smaller than in conventional plants. Other than that, the inclination of the treatment container 1 can be selected consistent with the different coefficients of friction of various textile fabrics. If the tub-shaped gliding bottom 16 according to FIG. 2 is set approximately horizontally, the treatment agent discharge in this treatment is closed by the flaps 26 and by the drain valve 27. The amount of treatment fluid flowing through the fabric strand outlet elbow 32 into the gliding bottom 16 flows with the fabric strand pile to the fabric strand outlet side 20, where said fluid overflows over the raised edge 16*b* of the gliding bottom 16 in the treatment container.

Of course, all the functions of the new long storage machines, including the adjustment of the nozzle gap 52, can be automatically controlled by a control device. This is advantageous in commission dyeing and allows the new long storage machine to treat virtually almost all occurring groups and areas of different textile fabrics within a large spectrum.

As a rule, the nominal loading weights for a long storage machine are not reached with light-weight textile fabrics. In order to reach the nominal treatment weight and keep the fabric strand circulation time within acceptable limits the machine may be equipped with several transport tubes 31. In this case, a transport tube 31 as described hereinabove is equipped with a transport nozzle 40 having an adjustable nozzle gap 52, whereas the other transport tubes 31 can be dimensioned—optionally without adjustment—for lighter-weight textile fabrics; however, this is not absolutely necessary. FIG. 14 shows an exemplary embodiment of this type. Considering the embodiment that has been previously described with reference to FIGS. 1 to 4, the same parts are identified with the same reference signs and need not being explained again.

The new long storage machine was described hereinabove as a hydraulic machine, wherein the transport of the fabric strand 17 is performed solely by the treatment fluid, and wherein the associate transport nozzle arrangement is configured accordingly. Basically however, it is also possible to apply the principle of the machine to long storage machines that operate pneumatically and/or mixed pneumatically/hydraulically. In these cases, the transport nozzle arrangement 14 comprises transport nozzle means that can be charged either with a transport gas and/or with a transport gas as well as with a transport fluid, in which case treatment agents in a suitable form, for example atomized, may be added to the transport gas, as has been known per se.

A device for treating strand-shaped textile fabric in the form of an endless fabric strand, which is set in circulation at least during part of the treatment, has a closable treatment container 1 and a transport nozzle arrangement 14 which is able to be subjected to a transport medium flow. The transport nozzle arrangement contains a transport nozzle 40 having an angular, rectilinearly delimited nozzle inlet opening 47 and a cross-sectionally angular outlet part 48, having correspondingly adapted dimensions, for the fabric strand, between which a nozzle gap for the transport medium is delimited. The nozzle gap 52 is settable and delimited all around by straight nozzle elements 46 which have a substantially part-cylindrical cross-sectional shape.

The invention claimed is:

1. A device for treatment of a strand-like textile fabric in the form of an endless fabric strand, the device comprising:

a lockable treatment container;

a transport nozzle arrangement which can be subjected to a first transport medium flow; and a transport section adjoining the transport nozzle arrangement, the transport section terminating on a fabric strand inlet side in a storage section of the lockable treatment container, the storage section accommodating a folded fabric strand pile, wherein:

the transport nozzle arrangement comprises a transport nozzle with:

a polygonal nozzle inlet opening delimited in straight lines; and an outlet part comprising a polygonal cross-section for the fabric strand, the outlet part having an outlet opening and being appropriately adapted in view of its dimensions, these delimiting between them a single nozzle gap for the transport medium;

the nozzle gap is adjustable; and at least one side of the nozzle gap is delimited all the way around by a plurality of straight nozzle elements, each of the straight nozzle elements having a cross-sectional shape that is essentially part-cylindrical, and the straight nozzle elements being connected to each other at ends thereof to delimit the nozzle inlet opening in the straight lines on all sides by essentially part-cylindrical surfaces.

2. The device of claim 1, wherein the nozzle gap is configured so as to taper conically in a flow direction.

3. The device of claim 1, wherein the nozzle inlet opening is rectangular.

4. The device of claim 3, wherein the outlet part is rectangular in cross-section.

5. The device of claim 1, wherein the nozzle inlet opening is square.

6. The device of claim 5, wherein the outlet part is square in cross-section.

7. The device of claim 1, wherein the nozzle inlet opening is formed on a tube section extending into a nozzle housing, the tube section comprising the plurality of straight nozzle elements.

8. The device of claim 1, wherein the nozzle inlet opening is formed on a part connected to the transport section, the part being supported so that it can be adjusted relative to the outlet part for adjustment of the nozzle gap.

9. The device of claim 1, wherein the outlet part is supported so that it can be adjusted relative to the nozzle inlet opening for adjustment of the nozzle gap.

10. The device of claim 9, wherein the outlet part is at least partially accommodated in a nozzle housing, and the nozzle housing can be adjusted together with the outlet part.

11. The device of claim 1, wherein the outlet part is secured against twisting relative to the nozzle opening.

12. The device of claim 1, further comprising a tube section of the transport section, the tube section connected adjoining the transport nozzle and comprising:

a polygonal cross-sectional shape corresponding to the nozzle inlet opening; and a cross-section that is constant over at least a part of its length.

13. The device of claim 12, further comprising a laterally expanding tube section of a transport tube of the transport section, such that the laterally expanding tube section is adjoining the tube section in a flow direction of the transport medium.

14. The device of claim 12, wherein the transport nozzle is supported so that it can be pivoted about an axis.

* * * * *